US005886323A

United States Patent [19]

Hivale

[11] Patent Number: 5,886,323

[45] Date of Patent: Mar. 23, 1999

[54] TEMPERATURE REGULATED MANICURE BOWL

[76] Inventor: Annie Hivale, P.O. Box 541448, Houston, Tex. 77254-1448

[21] Appl. No.: 811,242

[22] Filed: Mar. 3, 1997

[51] Int. Cl.[6] ..... H05B 1/02

[52] U.S. Cl. ..... 219/497; 219/481; 219/505; 219/428; 219/430; 4/493; 132/73.5

[58] Field of Search ..... 219/497, 505, 219/494, 428, 481, 433, 430; 4/493, 621, 639; 132/73, 73.5, 75

[56] References Cited

U.S. PATENT DOCUMENTS

| | | | |
|---|---|---|---|
| 0,890,857 | 6/1908 | Hadaway, Jr. | 219/430 |
| 1,170,170 | 2/1916 | Shailor et al. | 219/430 |
| 3,982,098 | 9/1976 | Trostler | 219/501 |
| 4,088,871 | 5/1978 | Coulmance et al. | 219/497 |
| 4,307,738 | 12/1981 | Barns | 132/74.5 |
| 4,742,836 | 5/1988 | Buehler | 134/182 |
| 5,465,436 | 11/1995 | Bleicher | 4/580 |
| 5,519,189 | 5/1996 | Gibisch | 219/430 |

*Primary Examiner*—Mark H. Paschall

[57] ABSTRACT

A temperature regulated manicure bowl is provided having a temperature control channel and an heating channel. The heating channel is provided to heat water to a preset temperature level. The temperature control channel is provided to control the heating channel, thereby regulating the temperature of the water. The temperature regulated bowl is also provided with a monitoring channel that monitor's the temperature control channel and the heating channel to insure proper operation. Additionally, a disposable sheath is provided to fit over the bowl. The disposable sheath is a means to prevent the spreading of hand born infections.

4 Claims, 3 Drawing Sheets

TEMPERATURE REGULATED MANICURE BOWL

TECHNICAL FIELD

This invention relates to a temperature regulated manicure bowl and more particularly to a Temperature Regulated Manicure Bowl to be used to facilitate the soaking of the hands and cuticles for manicuring. Regulated temperature control of liquids in manicure bowls is very important. The common practice in the beauty industry today is to warm water on a stove then pour it into a bowl. If the water is too hot, the person could be hurt; on the other hand, if the water is too cold, the cuticles will not be properly prepared for manicuring. Another major concern for in the beauty industry is the spread of hand born infections, since there are no standards for sterilizing manicure vessels today. This invention makes the art of manicuring very efficient by regulating the temperature of the liquid, and eliminates the spread of hand born infections.

BACKGROUND ART

Attempts have been made to provide devices for controlling the temperature of liquids in containers. One such device is disclosed in U.S. Pat. No. 4,409,694. In this device an electronics control means for controlling the temperature of the liquid is provided. The desired temperature control is accomplished by the execution of the instructions stored in the Programmable Read Only Memory (PROM). While this system attempts to provide a means for controlling the temperature of liquids, the temperature control means provided therein is inadequate for this application.

SUMMARY OF INVENTION

The invention relates to a temperature regulated device used for setting, controlling, and regulating the temperature of liquid in a vessel. The electronics control device, in accordance with the principles of this invention, includes a vessel with an opening formed therein. The device also includes an electrical power source. Coupled to the electrical power source is a temperature sensing means, and a monitoring means. Additionally, a means is provided for isolating the water that is directly heated by the heater element from mixing with the liquid that comes in contact with the person's hand(s). A means for monitoring the operation of the device is included.

BEST MODE FOR CARRYING OUT THE INVENTION

Figure 1:
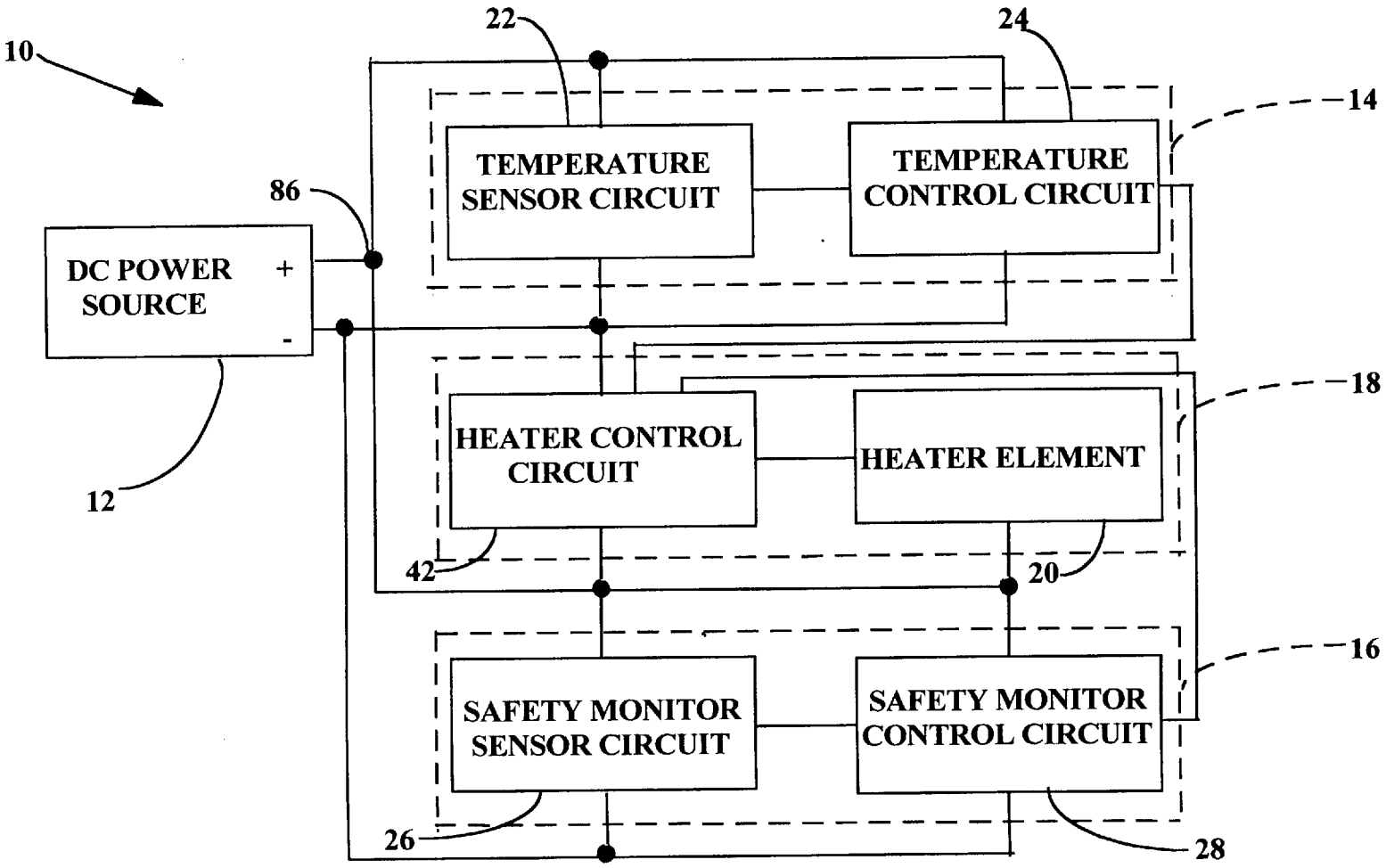
FIG. 1 is a block diagram of the Temperature Regulated Manicure Bowl in accordance with the principles of this invention.

In FIG. 1 there is shown, a Temperature Regulated Manicure Bowl, generally designated by the numeral 10. The Temperature Regulated Manicure Bowl 10 includes an electrical power source, generally designated by the numeral 12 and three electrical channels generally designated the numerals 14, 16, and 18, respectively. The voltage source 12 is coupled electrically to channels 14, 16, and 18. The channel 14 is a temperature control channel provided to activate and control the heating channel 18 to insure proper operation of the circuits. Channel 18 is provided with a heater control circuit 42 and a heater element 20.

The temperature control channel 14 of the Temperature Regulated Manicure Bowl 10 includes a water temperature sensor circuit, generally designated by the numeral 22, and a temperature control circuit, generally designated by the numeral 24.

The monitoring channel 16 of the Temperature Regulated Manicure Bowl 10 includes a sensor circuit, generally designated by the numeral 26.

Figure 2:
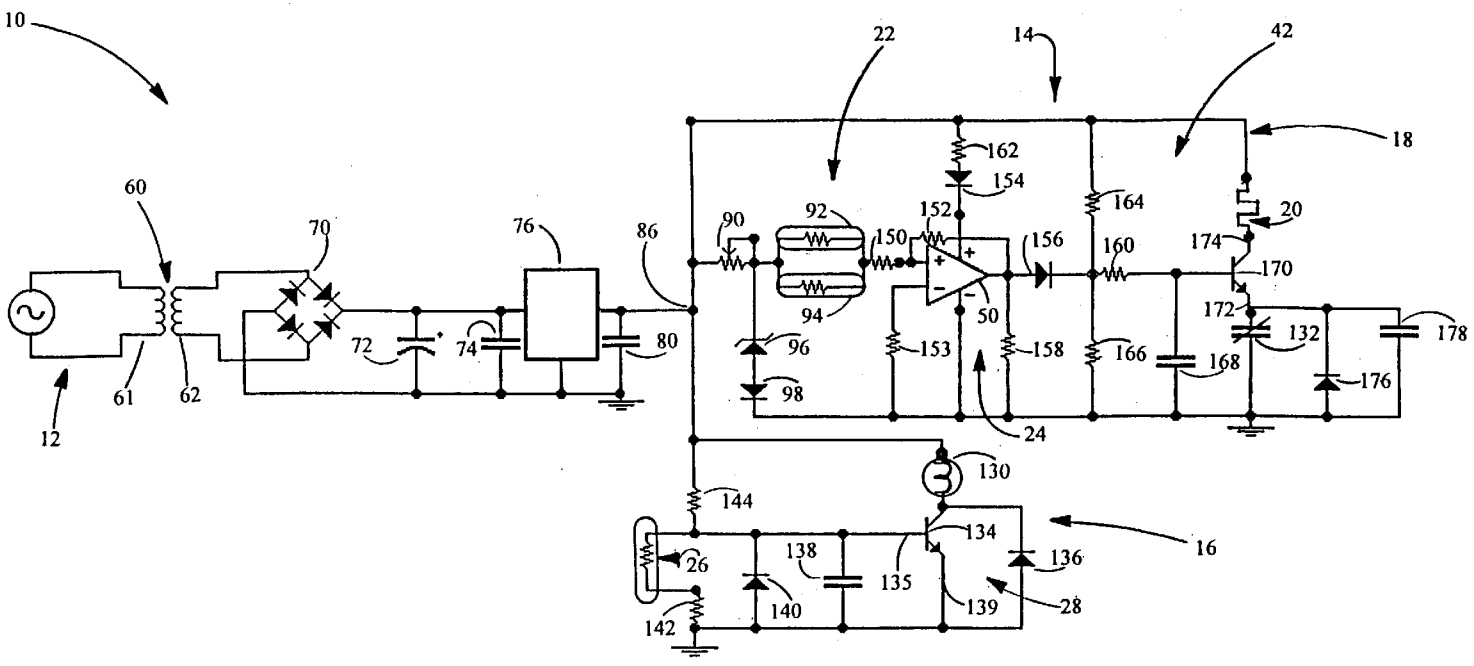
FIG. 2 is an electronics schematic diagram illustrating the various circuit components of the block diagram of FIG. 1 in accordance with the principles of this invention.

Referring to FIG. 2 the power source 12 of the Temperature Regulated Manicure Bowl 10 is equipped with a power transformer 60 having a primary winding 61 and a secondary winding 62. A rectifier 70 is provided to convert alternating current (AC) voltage to direct current (DC) voltage. Capacitors 72, 74, and 80 are provided to filter out the ripples. A voltage regulator 76 is provided to keep the DC voltage at terminal 86 constant. This method of converting single phase ac voltage to regulated DC voltage is a well known art.

Variable resistor 90, zener diode 96 and general purpose diode 98, form a voltage divider network that provides an input bias voltage for the water temperature sensor circuit 22. Positive temperature coefficient resistors 92 and 94 are wired in parallel, and this parallel combination of 92 and 94 is connected in series with the variable resistor 90 and the input resistor 150. The total gain of the temperature control circuit 24 is governed by resistors 92,94,150, 152, and Operational Amplifier 50. Resistors 153 and 158 are used for stabilizing 50. Diodes 154 and 156 are used for circuit decoupling purposes, while resistors 164,166, and 160 form a voltage divider network to supply bias voltage to transistor 170. Capacitors 168 and 178 combined with diode 176 are used for transient suppression. Heater element 20 is used to heat the water, and normally closed relay contact 132 is used to deactivate heater control circuit 42. Positive temperature coefficient resistor 26, and resistors 142 and 144 form a voltage divider network for terminal 135 of transistor 134. Diodes 136 and 140 in combination with capacitor 138 are used for transient suppression. Said relay opens its normally closed contact when energized.

Figure 3:
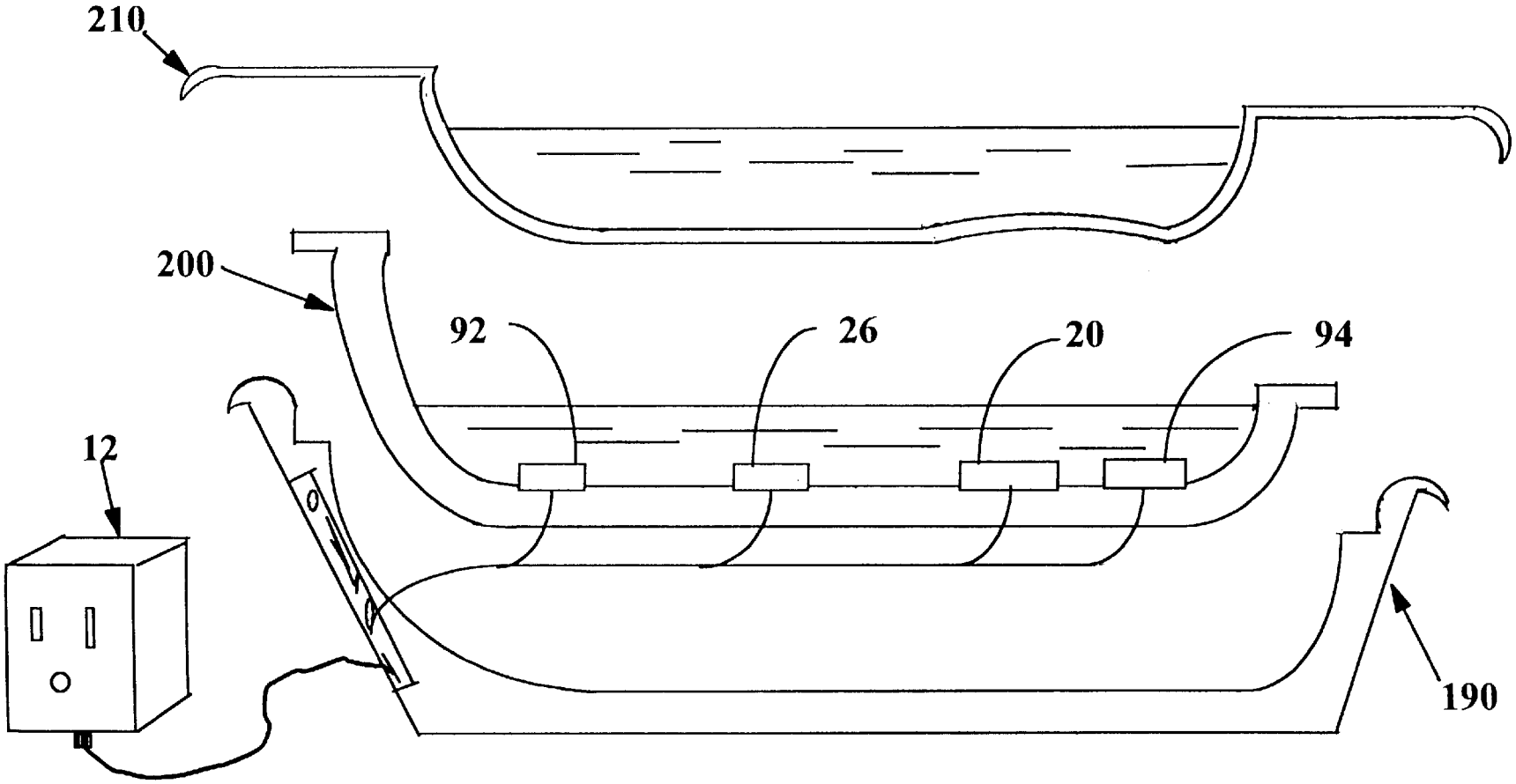
FIG. 3 is a sectional view of the bowl in accordance with the principles of this invention.

Referring to FIG. 3 there is shown a sectional view of the bowl in accordance with the principle of this invention. The primary enclosure 190, which is water tight, houses the electrical circuits for sensors 92, 94, 26, and heater element 20; but the heater element and the sensors are housed in secondary enclosure 200. Enclosure 210 is a disposable sheath that is fitted over the secondary enclosure 200.

To operate the Temperature Regulated Manicure Bowl 10, tap water is poured into 200, then 210 is placed over 200. The liquid that comes in contact with the person's hand is poured into 210, then power is applied. If the water temperature in 200 is below the preset temperature, sensors 92 and 94 senses this, as a result the ohmic values of 92 and 94 is reduced proportionally to the temperature of the water. The reduction in ohmic values of 92 and 94, causes the voltage gain (AV) of the temperature control circuit 24 to increase. The voltage gain of 24 is governed by the Operational Amplifier is the active component in this circuit. The lowest ohmic values of 92 and 94, the voltage gain of 24 will be at its highest. When the output voltage is high enough, 156 becomes forward biased, causing current to flow from 50, through 160, then to 170 via 171. The current entering

171 causes transistor 170 to turn on, causing high current to flow from the DC power supply terminal 86, through the heating element 20, to transistor 170. This current heats up 20 as it flows through it, the passes through transistor 170, then to ground via a series connected normally closed relay contact 132. Heating element 20 continues to heat the water in enclosure 200, causing heat energy to be generated in disposable sheath 210 causing the temperature of the liquid therein to rise. Transistor 170 remains turned on as long as the output voltage is high enough. As the temperature of the contents in enclosures 200 and 210 rise, sensors 92 and 94 resistance increase causing the voltage gain of 24 to decrease. When the temperature of water in enclosure 200 reaches the preset level, the voltage gain of 24 approaches zero volt. At this point transistor 170 turns off, deenergizing heater element 20. When the temperature of the water drops below the preset level, the heating cycle restarts.

During the period of normal operation safety monitor sensor 26 is active but safety monitor control circuit 28 remains deactivated. If a malfunction occurs which causes the temperature of the water to rise higher than the preset value, sensor 26 ohmic value rises causing the voltage at transistor 134 base to rise. This rise in voltage turns of transistor 134, causing current to flow from the DC power source 86, through relay coil 130, via transistor 134 to ground. When relay coil 130 is energized, its normally closed contact becomes open, deactivating 18.

What is claimed is:

1. A temperature regulated manicure bowl comprising:

a primary enclosure made of high temperature polymer having temperature control circuits housed therein;

a secondary enclosure disposed within the primary enclosure;

a heating means disposed within the secondary enclosure for heating water;

a safe low voltage power supply for connection to the heating means;

means for sensing the water temperature in the secondary enclosure and means responsive to said sensing means for controlling the supply of power to the heating means from the power supply;

a disposable sheath constructed to fit water tight over the secondary enclosure, wherein water is placed for heating in said disposable sheath and the water in the sheath is heated via conduction of heat from the water heated in the secondary enclosure.

2. A temperature regulated manicure bowl as defined in claim 1 wherein the temperature control means includes one or more thermistor sensors, an operational amplifier, and coupling components that change the gain of the operational amplifier and that automatically adjust the temperature of the water in the secondary enclosure.

3. A temperature regulated manicure bowl as defined in claim 2 wherein the temperature control means include a transistor with coupling components, wherein the transistor is turned on or off in response to a signal from the temperature control means.

4. A temperature regulated manicure bowl as defined in claim 3 wherein a safety control means is included, said safety control means including a thermistor, a relay and a transistor, the relay coil connected to the collector of the transistor, said thermistor biasing the transistor, wherein if the water temperature exceeds a preset level, said transistor biasing the relay coil to disconnect the heating means from the power supply.

* * * * *